US010712763B2

(12) United States Patent
Mouret et al.

(10) Patent No.: US 10,712,763 B2
(45) Date of Patent: Jul. 14, 2020

(54) SUB-BANDGAP REFERENCE VOLTAGE SOURCE

(71) Applicant: NXP USA, INC., Austin, TX (US)

(72) Inventors: Guillaume Mouret, Toulouse (FR); Thierry Michel Alain Sicard, Auzeville Tolosane (FR); John Pigott, Phoenix, AZ (US)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 16/701,393

(22) Filed: Dec. 3, 2019

(65) Prior Publication Data

US 2020/0192414 A1 Jun. 18, 2020

(30) Foreign Application Priority Data

Dec. 18, 2018 (EP) ..... 18306711

(51) Int. Cl.
*G05F 1/10* (2006.01)
*G05F 3/30* (2006.01)
*G05F 3/26* (2006.01)

(52) U.S. Cl.
CPC ..... *G05F 3/267* (2013.01); *G05F 3/30* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,282,477 | A | 8/1981 | Ahmed | |
| 6,630,859 | B1 * | 10/2003 | Wang | G05F 3/30 323/313 |
| 6,661,713 | B1 * | 12/2003 | Kuo | G05F 3/30 327/539 |
| 8,400,213 | B2 | 3/2013 | Sicard | |
| 9,110,485 | B2 | 8/2015 | Sicard | |
| 2009/0302823 | A1 | 12/2009 | Chao et al. | |

* cited by examiner

*Primary Examiner* — An T Luu

(57) ABSTRACT

The present application relates to a sub-bandgap reference source circuit, which comprises a current mirror source, a first branch comprising a first BJT and a second branch comprising a second BJT, the first BJT having an emitter current density lower than an emitter current density of the second BJT, the first branch and the second branch being connected at a first node coupled to ground; a first voltage divider comprising first and second resistances coupled in series, the first resistance being coupled between a base terminal of the first BJT and a second node, the second resistor being coupled to ground; a second voltage divider comprising first and second resistances coupled in series, the first resistance being coupled between the second node and a base terminal of the second BJT, the second resistance being coupled to the first node; and an output terminal coupled to the second node.

15 Claims, 10 Drawing Sheets

SUB-BANDGAP REFERENCE VOLTAGE SOURCE

CROSS-REFERENCE TO RELATED APPLICATIONS

This application claims priority under 35 U.S.C. § 119 to European Patent Application No. 18306711.5, filed on Dec. 18, 2018, the contents of which are incorporated by reference herein.

FIELD OF THE INVENTION

The present invention relates generally to a bandgap reference voltage source, which in particular comprises two bipolar transistors operated at differing current densities. More particularly, the present invention relates to a sub bandgap reference voltage source with in particular an advantageous low power consumption.

BACKGROUND

Bandgap references or bandgap reference sources are used in many integrated circuits to produce "stable" and "temperature-independent" voltage references. Different topologies are known in the art to implement bandgap reference sources, which include in particular the bipolar junction transistor (BJT)-based references having an output voltage of typically 1.2 V and are not suitable for supply voltages at or below 1 V. Solutions that are based on resistive sub-divisions are further known in the art to realize sub-bandgap references. Nonetheless, the existing solutions suffer from a high-power consumption.

SUMMARY

The present invention provides a sub-bandgap reference voltage source circuit as described in the accompanying claims. Specific embodiments of the invention are set forth in the dependent claims. These and other aspects of the invention will be apparent from and elucidated with reference to the embodiments described hereinafter.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION

Figure 1:
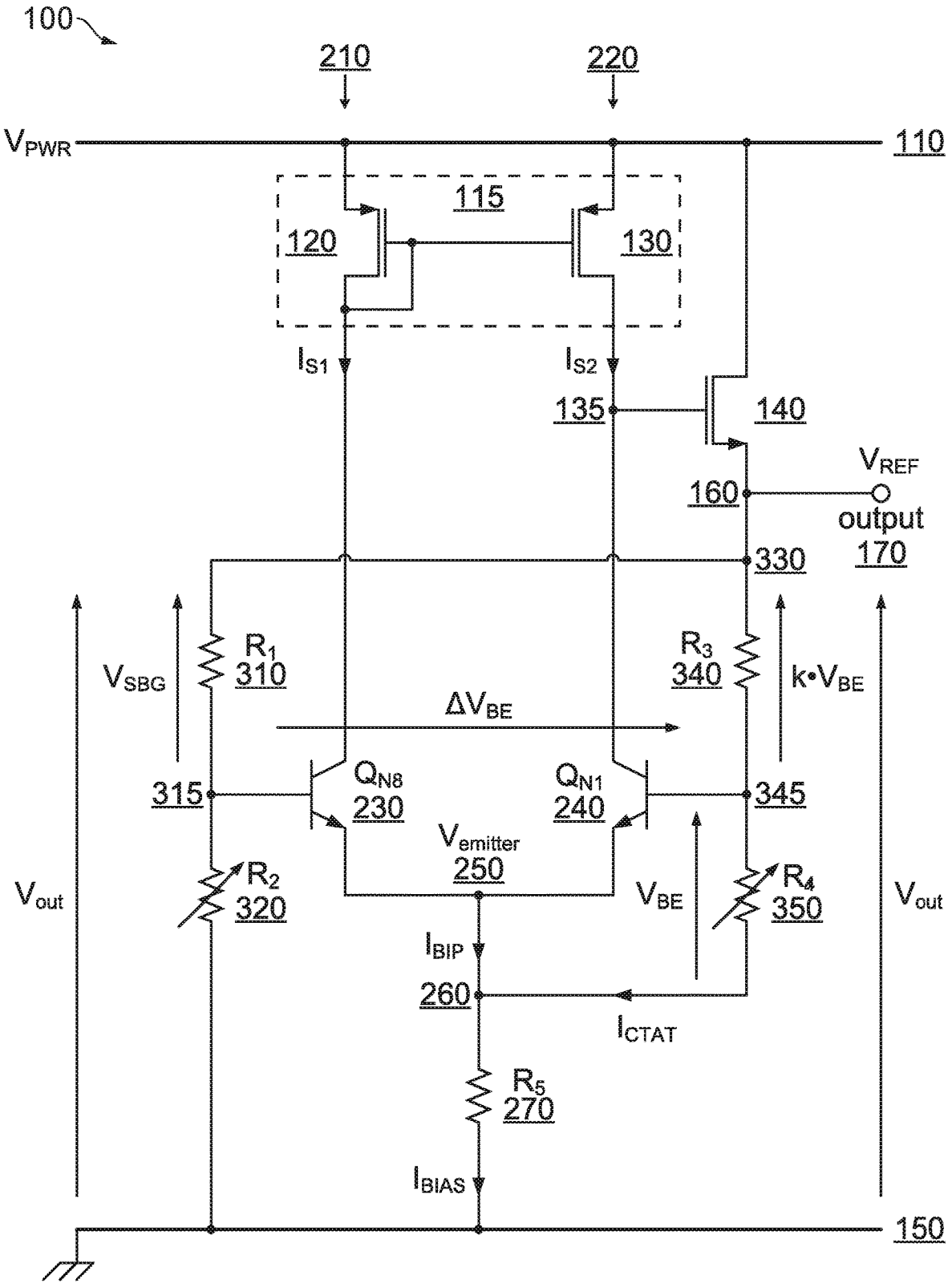
FIG. 1 schematically illustrates a circuit diagram of a bandgap reference circuit according to an example of the present invention.

Embodiments of the present disclosure will be described below in detail with reference to drawings. Note that the same reference numerals are used to represent identical or equivalent elements in figures, and the description thereof will not be repeated. The embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Referring to FIG. 1, a schematic circuit diagram of a bandgap reference circuit according to an embodiment of the present invention is illustrated.

The exemplified circuit 100 comprises a current mirror circuitry 115 supplied from a supply voltage rail 110 providing a supply voltage signal $V_{PWR}$. The current mirror circuitry 115 provides a current $I_{S2}$ at its output from a current $I_{s1}$ at its input. The current mirror circuitry 115 ensures the current at its output is the same as at its input, e.g. $I_S=I_{S1}=I_{S2}$. In an example, the current mirror circuitry 115 comprises the transistors 120 and 130. Each one of the transistors 120 and 130 provides the respective one of the currents $I_{S1}$ and $I_{S2}$ at a first one of its current terminals, whereas a second one of the current terminals of each transistor 120 and 130 is coupled to the supply voltage rail 110. In particular, the control terminal of the transistor 130 is connected to the current terminal of the transistor 120 receiving the current $I_{S1}$ and is further connected to the control terminal of the transistor 120.

In an example, the transistors 120 and 130 are MOSFETs (metal-oxide-semiconductor field-effect transistor). In particular, the transistors 120 and 130 are p-channel MOSFETs. The source terminals of the transistors 120 and 130 are connected to the supply voltage rail 110. The drain terminals of the transistors 120 and 130 conduct the current signals $I_{S1}$ and $I_{S2}$. The gate terminal of the transistor 130 is connected to the drain terminal and to the gate terminal of the transistor 120.

The current mirror circuitry 115 supplies the current signals $I_{S1}$ and $I_{S2}$ to two branches 210 and 220. The first branch 210 comprises a bipolar junction transistor (BJT) 230 and the second branch 220 comprises a bipolar junction transistor (BJT) 240. In particular, the BJTs 230 and 240 are npn-type bipolar transistors. The BJT 240 ($Q_{N1}$) of the second branch 220 is operated at an emitter current density which is substantially higher than the emitter current density of the BJT 230 ($Q_{N8}$) of the first branch 220. For instance, the emitter current density of the BJT 240 may be a factor 8 higher than the emitter density of the BJT 230. In general, the emitter current density of the BJT 240 may be higher than the emitter density of the BJT 230 by a factor above 1. For instance, the factor may be in a range of 8 to 15. The currents in branches 210 and 220 combine at an emitter junction node 250 downstream after passing through the BJTs 230 and 240 and the emitter junction node 250 is further connected to ground, e.g. to a ground rail 150, via a bias resistor $R_5$ 270.

In an example, the source-drain paths of the transistors 120 and 130 of the current mirror circuitry 115 are connected in series with the branches 210 and 220. In particular, the collector terminals of the BJTs 230 and 240 are connected to the current mirror and the emitter terminals of the BJTs 230 and 240 are connected to the emitter junction node 250. An emitter voltage $V_{emitter}$ is present at the emitter junction node 250, which is common to the emitter terminals of the BJTs 230 and 240. A current $I_{BIP}$ flows from the emitter junction node 250 to ground. The current $I_{BIP}$ corresponds to the combined current of the source current signals $I_{S1}$ and $I_{S2}$ each flowing through the respective one of the BJTs 230 and 240.

A first resistance-based voltage divider comprising a resistor $R_1$ 310 and a resistor $R_2$ 320 is coupled between a reference output voltage node 160 and ground, e.g. the ground rail 150. A common node 315 of the resistors $R_1$ 310 and $R_2$ 320 is connected to the base terminal of the BJT 230 of the first branch 210.

A second resistance-based voltage divider comprising a resistor $R_3$ 340 and a resistor $R_4$ 350 is coupled between the reference output voltage node 160 and the emitter terminals of the BJTs 230 and 240. A node 345 between the resistor $R_3$ 340 and the resistor $R_4$ 350 is connected to the base terminal of the BJT 240 of the second branch 220.

The first and second resistance-based voltage dividers are connected at a divider junction node 330. The current terminals of a transistor 140 are connected in series between the supply voltage rail 110 and the divider junction node 330. The control terminal of the transistor 140 is connected to the second branch at a node 135. The transistor 140 supplies a current $I_{S3}$ to the first and second resistance-based voltage dividers as well as provides the output reference voltage signal $V_{REF}$.

In an example, the transistor 140 is a MOSFET and in particular an n-channel MOSFET. More particularly, the drain terminal of the transistor 140 is connected to the supply voltage rail 110 and the source terminal of the transistor 140 is connected to the divider junction node 330. The gate terminal of the transistor 140 is connected to the second branch.

In operation, the difference in the emitter current densities of the BJT 230 and 240 produces a related voltage difference $\Delta V_{BE}$ between the base-emitter voltages. The collector currents in the two branches are the same. The BJT 240 ($Q_{N1}$) is chosen to have an emitter current density, which is higher than the emitter current density of the BJT 230 ($Q_{N8}$) Therefore, the voltage difference $\Delta V_{BE}$ between the base-emitter voltages occurs.

The base-emitter voltage $V_{BE}$ of the BJT 240 (wherein the BJT 240 has the higher emitter current density) occurs between base and emitter terminals of the BJT 240, e.g. between the nodes 345 and 250 and is hence applied to the resistor $R_4$ 350 of the second voltage divider. The voltage division ratio of the second voltage divider is $$\frac{R_4}{R_3 + R_4}.$$

Consequently, a voltage is applied to the resistor $R_3$ 340 of the second voltage divider, which correspond to $k \cdot V_{BE}$, wherein the factor k is the ratio of resistances of the second voltage divider:

$$k = \frac{R_3}{R_4}.$$

A sub-bandgap voltage $V_{SBG}$ occurs across the resistor $R_1$ 310 of the first voltage divider, e.g. between the divider junction node 330 and the node 315. The sub-bandgap voltage $V_{SBG}$ is equal to the sum of the related voltage difference $\Delta V_{BE}$ and the base-emitter voltage $k \cdot V_{BE}$ scaled by factor k:

$$V_{SBG}=\Delta V_{BE}+k \cdot V_{BE}.$$

The relationship of the above voltages can be obtained from the schematic circuit diagram shown in FIG. 1.

The output signal $V_{REF}$ of the bandgap reference circuit according to an embodiment of the invention can be tapped at the junction of the transistor 140 and the first and the second voltage dividers. The output signal is provided at an output terminal 170 connected at a reference output voltage node 160 for instance at the junction of the transistor 140 and the divider junction node 330. The voltage $V_{REF}$ occurring at the reference output voltage node 160 and an output terminal 170 connected thereto is $$V_{REF} = V_{SBG} \cdot \left(1 + \frac{R_1}{R_2}\right) = \left(\Delta V_{BE} + \frac{R_3}{R_4} \cdot V_{BE}\right) \cdot \left(1 + \frac{R_1}{R_2}\right).$$

As known by those skilled in the art, the related voltage difference $\Delta V_{BE}$, i.e. the difference between the base-emitter voltages of the two BJTs 230 and 240, is proportional to absolute temperature (PTAT), wherein the base-emitter voltage $V_{BE}$ of the BJT 240 is complementary to absolute temperature (CTAT). The related voltage difference $\Delta V_{BE}$ and the base-emitter voltage $V_{BE}$ contribute to the sub-bandgap voltage $V_{SBG}$, wherein the positive temperature dependency of the related voltage difference $\Delta V_{BE}$ and the negative temperature dependency of the base-emitter voltage $V_{BE}$ are chosen to compensate each other to generate a voltage reference with less variation over temperature.

For instance, the related voltage difference $\Delta V_{BE}$ is approximately 54 mV and the base-emitter voltage $V_{BE}$ is approximately 600 mV. When assuming that the voltage division scaling factor k=1/10, a sub-bandgap voltage $V_{SBG}$ results in $$V_{SBG} = \Delta V_{BE} + k \cdot V_{BE} \approx 54\ \text{mV} + \frac{1}{10} 600\ \text{mV} = 114\ \text{mV}.$$

The sub-band-gap voltage $V_{SBG}$ is amplified in a loop amplification to produce the output voltage signal $V_{REF}$. The amplification is given by the amplification factor $$1 + \frac{R_1}{R_2}.$$

Hence, a desired output voltage $V_{REF}$ of the bandgap reference circuit according to an embodiment of the present invention can be implemented by choosing appropriate resistance values of the resistor $R_1$ 310 and the resistor $R_2$ 320 of the first voltage divider.

Those skilled in the art will further understand from the above described dependencies of the output voltage $V_{REF}$, which is $$V_{REF} = V_{SBG} \cdot \left(1 + \frac{R_1}{R_2}\right) = \left(\Delta V_{BE} + \frac{R_3}{R_4} \cdot V_{BE}\right) \cdot \left(1 + \frac{R_1}{R_2}\right),$$

that the output voltage $V_{REF}$ is trimmable.

In an example, the resistor $R_4$ 350 and/or the resistor $R_3$ 340 may be trimmed. For instance, trimming of the resistor $R_4$ 350 allows adjustment of the contribution of the base-emitter voltage $V_{BE}$ to the sub-band-gap voltage $V_{SBG}$. Accordingly, trimming of the resistor $R_4$ 350 enables adjustment of the temperature dependency, e.g. the temperature coefficients, of the output voltage $V_{REF}$. For example, trimming of the resistor $R_4$ 350 enables compensation for process and/or mismatch variations.

In an example, the resistor $R_2$ 320 may be trimmed. For example, trimming of the resistor $R_2$ 320 allows adjustment of the output voltage $V_{REF}$ without affecting the above discussed temperature dependency of the output voltage $V_{REF}$. For instance, in case the temperature dependency is acceptable with respect to process and/or mismatch variations, the bandgap reference circuit may be trimmed only with respect to the absolute output voltage $V_{REF}$. Otherwise, the bandgap reference circuit may be trimmed with respect to temperature dependency and the absolute output voltage $V_{REF}$.

The skilled person understands from the above description, that trimming is not limited to the resistor $R_4$ 350 and resistor $R_2$ 320. The resistors $R_1$ 310 and $R_3$ 340 may be also trimmed to adjust temperature dependency and absolute output voltage $V_{REF}$, respectively.

Referring to FIGS. 2 and 3, the results of 3000 random simulation runs of the above described bandgap reference circuit are shown. The simulation has been conducted with $$k = \frac{1}{10},\ 1 + \frac{R_1}{R_2} = \frac{25}{3}$$

and a target output voltage $V_{REF}$=1 V. The temperature T has been varied over a range between −40° C. and 200° C. As understood from the illustrated diagrams in FIGS. 2*a* and 2*b*, which illustrate the temperature dependent output voltage $V_{REF}$, the bandgap reference circuit according to an embodiment of the present application achieves an accuracy of the output voltage $V_{REF}$ better than +/−2% without trim (cf. FIG. 2*a*, where the output voltage $V_{REF}$ varies in the range of approximately 2.5%) and an accuracy of the output voltage $V_{REF}$ better than +/−0.5% in response to a single test insertion at room temperature for absolute trimming.

Figure 2A:
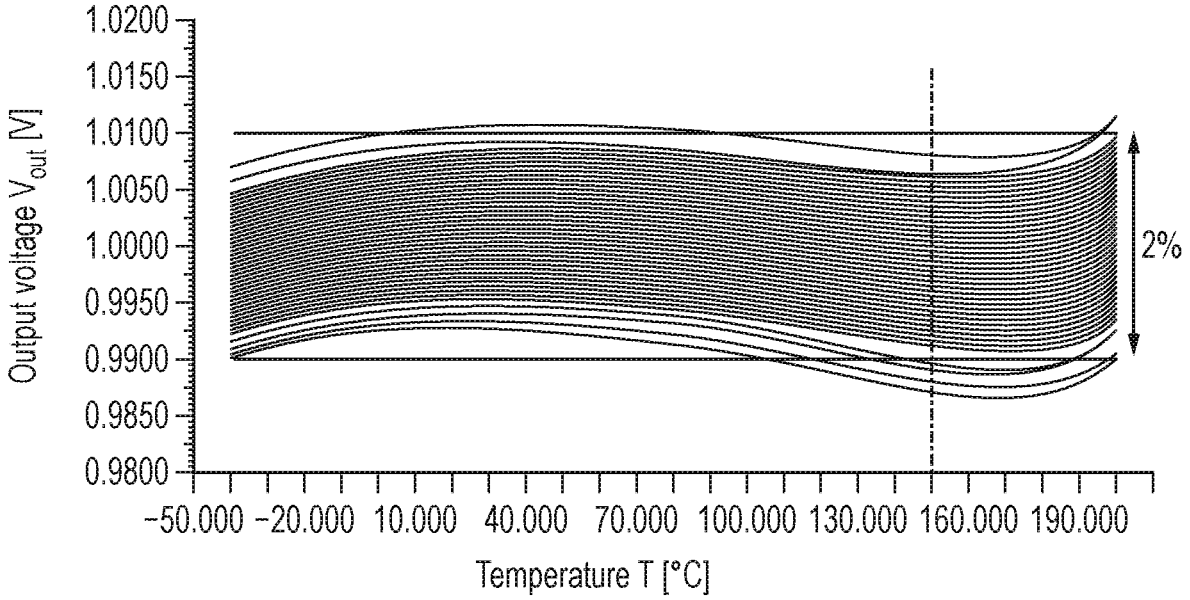
FIG. 2*a* schematically illustrates a diagram of the temperature and/or process & mismatch variation dependent output voltage $V_{REF}$ of the bandgap reference circuit before trimming according to an example of the present invention.
Figure 2B:
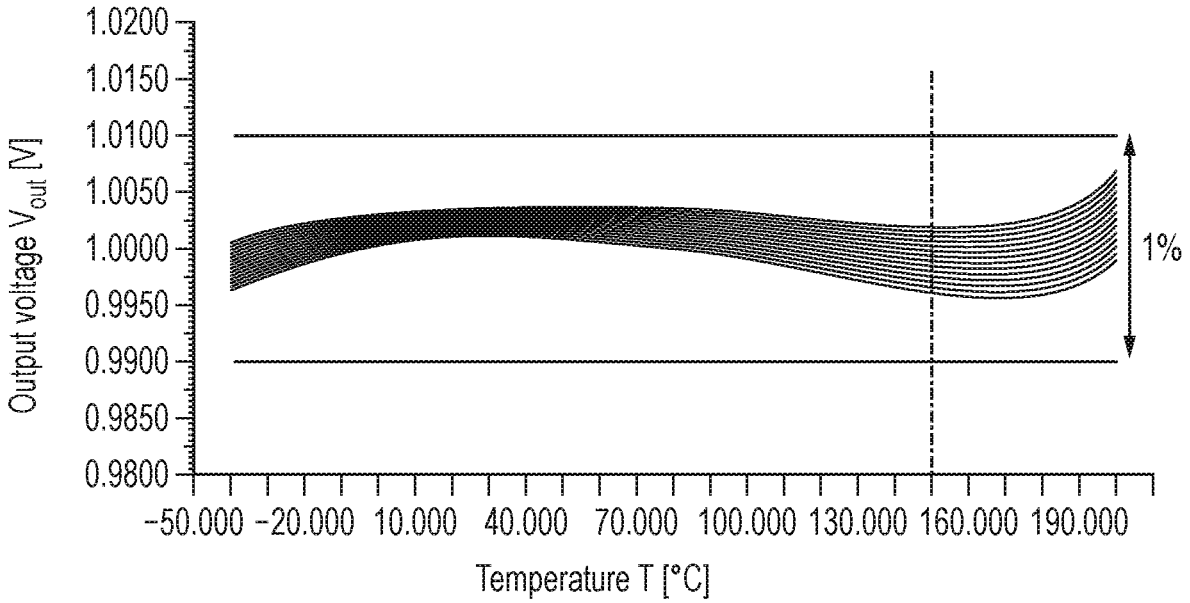
FIG. 2*b* schematically illustrates a diagram of the temperature and/or process & mismatch variation dependent output voltage $V_{REF}$ of the bandgap reference circuit after trimming according to an example of the present invention.
Figure 3A:
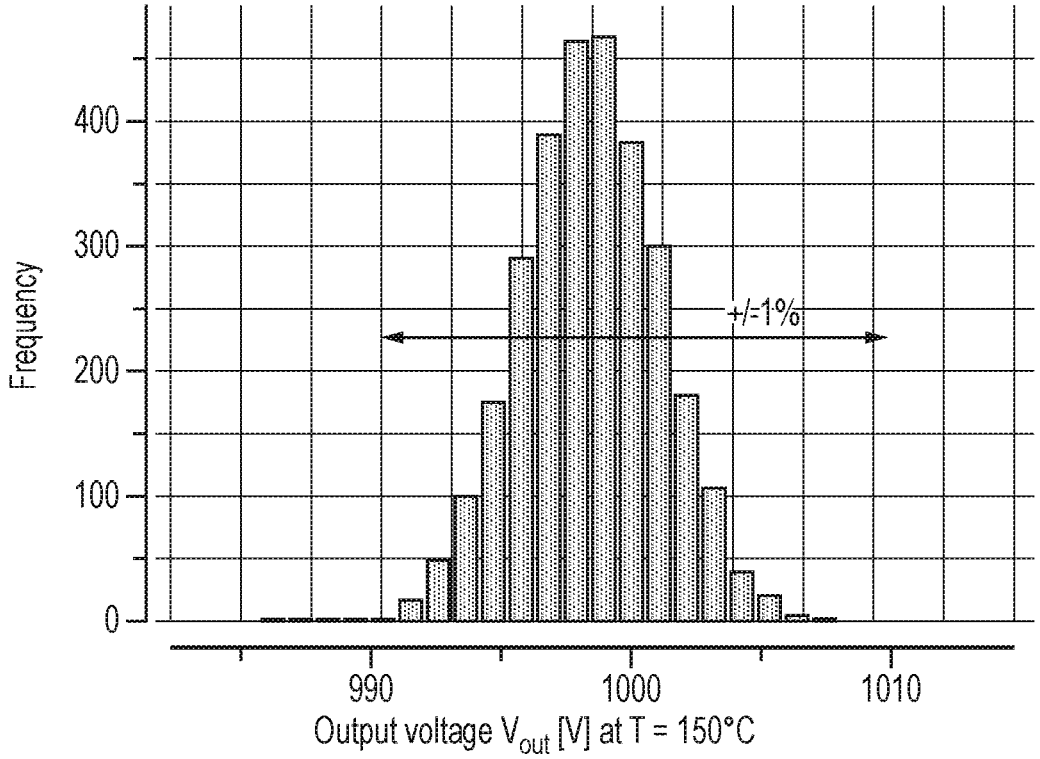
FIG. 3*a* schematically illustrates a frequency histogram of the process & mismatch variation dependent output voltage $V_{REF}$ of the bandgap reference circuit before trimming according to an example of the present invention.
Figure 3B:
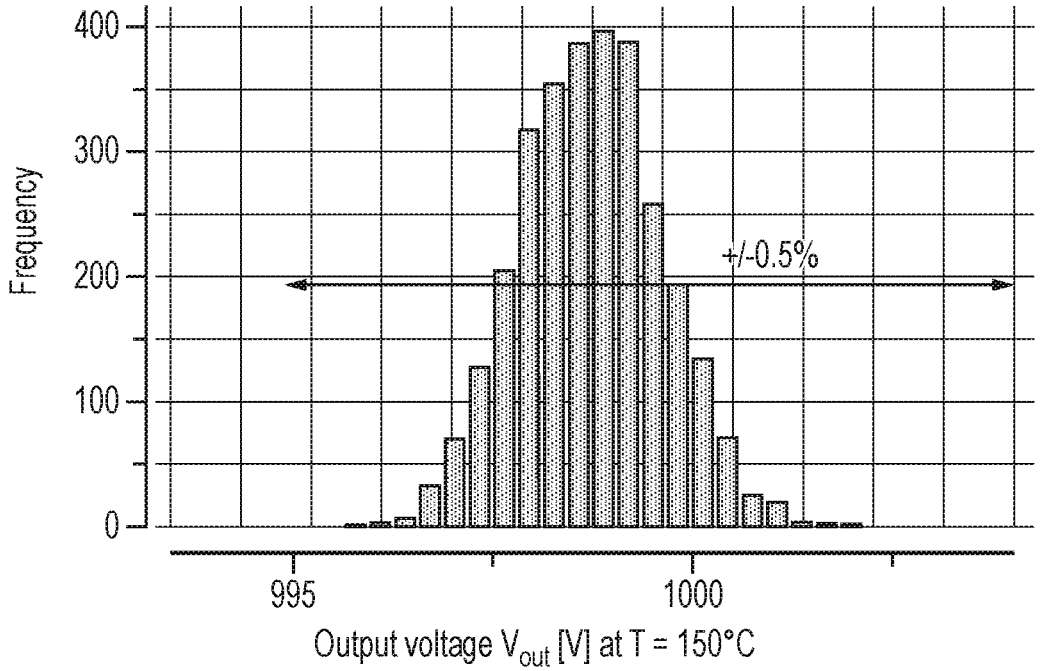
FIG. 3*b* schematically illustrates a frequency histogram of the process & mismatch variation dependent output voltage $V_{REF}$ of the bandgap reference circuit after trimming according to an example of the present invention.

FIGS. 3*a* and 3*b* illustrate frequency histograms of output voltage $V_{REF}$ determined by the simulation runs shown in FIGS. 2*a* and 2*b*, respectively, at a temperature of 150° C. Without trim as shown in FIG. 3*a*, the mean output voltage $V_{REF}$ is 998.5 mV with a standard deviation of 2.8 mV. The maximum output voltage $V_{REF}$ is 1.008 V and the minimum output voltage $V_{REF}$ is 986.7 mV. With a single test insertion trim as shown in FIG. 3*b*, the mean output voltage $V_{REF}$ is 998.7 mV with a standard deviation of 877 μV. The maximum output voltage $V_{REF}$ is 1.002 V and the minimum output voltage $V_{REF}$ is 995.9 mV.

Referring first back to FIG. 1, the properties and characteristics of the current $I_{BIP}$, which flows from the emitter junction node 250 to ground, should be further discussed for a fuller understanding of the operation of the bandgap reference circuit according to an embodiment of the present application. The bipolar current $I_{BIP}$ is dependent on the emitter voltage $V_{emitter}$ at the emitter junction node 250. The emitter voltage $V_{emitter}$ is equal to $$V_{emitter} = V_{REF} - V_{SBG} - V_{BE}.$$

Figure 4A:
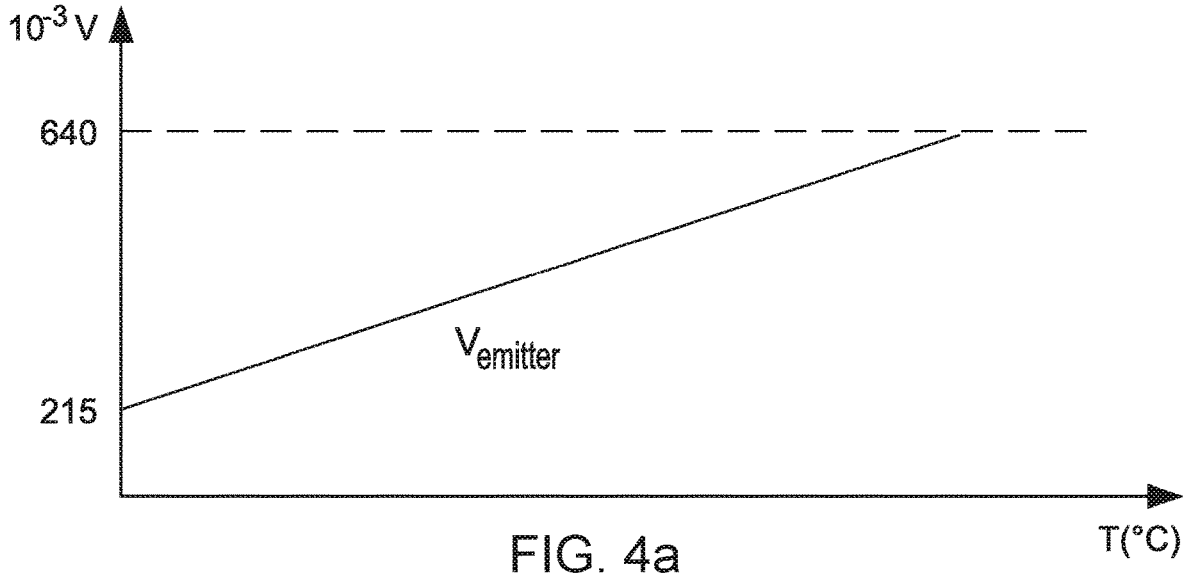
FIG. 4*a* schematically illustrates a diagram of the emitter voltage $V_{emitter}$ over temperature of the bandgap reference circuit according to an example of the present invention.
Figure 4B:
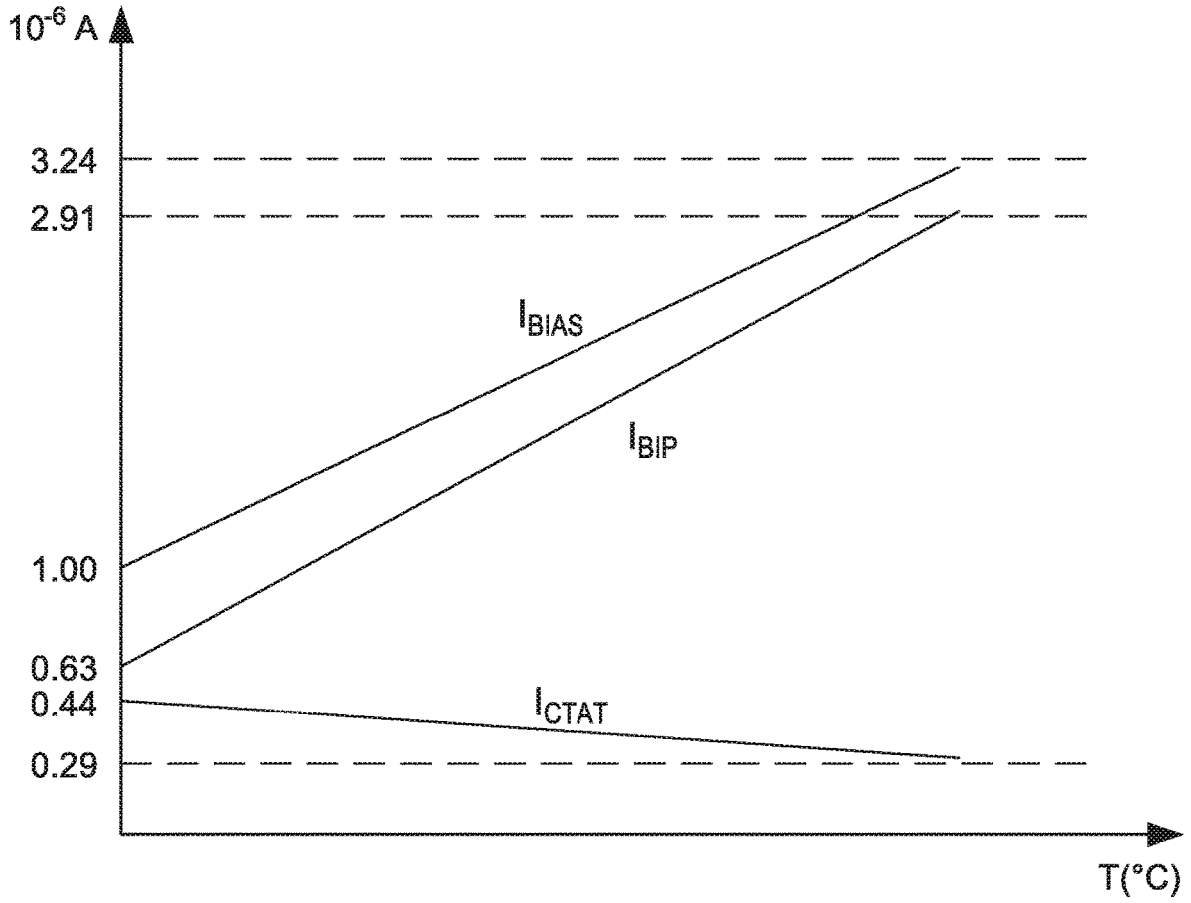
FIG. 4*b* schematically illustrates a diagram of the bipolar current $I_{BIP}$ of the bandgap reference circuit according to an example of the present invention.

Hence, the emitter voltage $V_{emitter}$ has a (strong) positive temperature dependency. FIG. 4*a* schematically shows a diagram of the emitter voltage $V_{emitter}$ over temperature illustrating the variation of the emitter voltage $V_{emitter}$. FIG. 4*b* schematically shows a diagram of the bipolar current $I_{BIP}$ flowing from emitter junction node 250 to ground, the bias current $I_{BIAS}$ flowing through the bias resistor $R_5$ 270 and the current $I_{CTAT}$ flowing through resistor $R_4$ 350, wherein $$I_{CTAT} = \frac{V_{BE}}{R_4};$$

$$I_{BIP} = I_{BIAS} - I_{CTAT} = I_{BIAS} - \frac{V_{BE}}{R_4};$$

$$I_{BIAS} = \frac{V_{emitter}}{R_5}.$$

The variation range of the temperature dependent emitter voltage $V_{emitter}$ produces a corresponding variation range of the bias current $I_{BIAS}$. In order to mitigate the strong positive temperature dependency of the bias current (BIAS, the bias resistor $R_5$ 270 may be selected with appropriate temperature coefficient(s). The temperature dependent resistance of the bias resistor $R_5$ 270 may be modelled as following:

$$R(T)=R_0[1+(T-T_0)\cdot tc_1+(T-T_0)^2\cdot tc_2],$$

wherein T[° C.] is the temperature and $R_0$ is an initial resistance at a corresponding initial temperature $T_0$ such as at room temperature $T_0$=Tr, e.g. $T_r$ [° C.]=27° C.). The resistor may be chosen to have temperature coefficients $tc_1$ and $tc_2$ to mitigate or at least minimize the strong positive temperature dependency of the bias current $I_{BIAS}$. Herein the model of the temperature dependent resistance comprises a fixed component $R_0$, a linear component $R_0\cdot(T-T_0)\cdot tc_1$ and a quadratic component $R_0\cdot(T-T_0)^2\cdot tc_2$.

Next, the temperature dependency or curvature of the emitter voltage $V_{BE}$ should be considered. Note that the aforementioned relationship applies to the bipolar current $I_{BIP}$, the bias current $I_{BIAS}$ and the emitter current $I_{CTAT}$:

$$I_{BIP} = I_{BIAS} - I_{CTAT} = I_{BIAS} - \frac{V_{BE}}{R_4}.$$

The emitter voltage $V_{BE}$ as a function of temperature is approximated as following:

$$V_{BE}(T) = V_{G0}\left(1 - \frac{T}{T_r}\right) + \frac{T}{T_r}\cdot V_{BE}(T_r) - (\eta - m)\cdot\frac{kT}{q}\cdot\ln\left(\frac{T}{T_r}\right)$$

wherein $V_{G0}$ is the gap voltage of silicon extrapolated at 0K, k is Boltzmann's constant, q is the electric charge, T[K] is the temperature, $T_r$[K] is the room temperature, $\eta$=4−n being a parameter that depends of the base doping and m is defined as the exponent of the temperature variation of the collector current.

Figure 5:
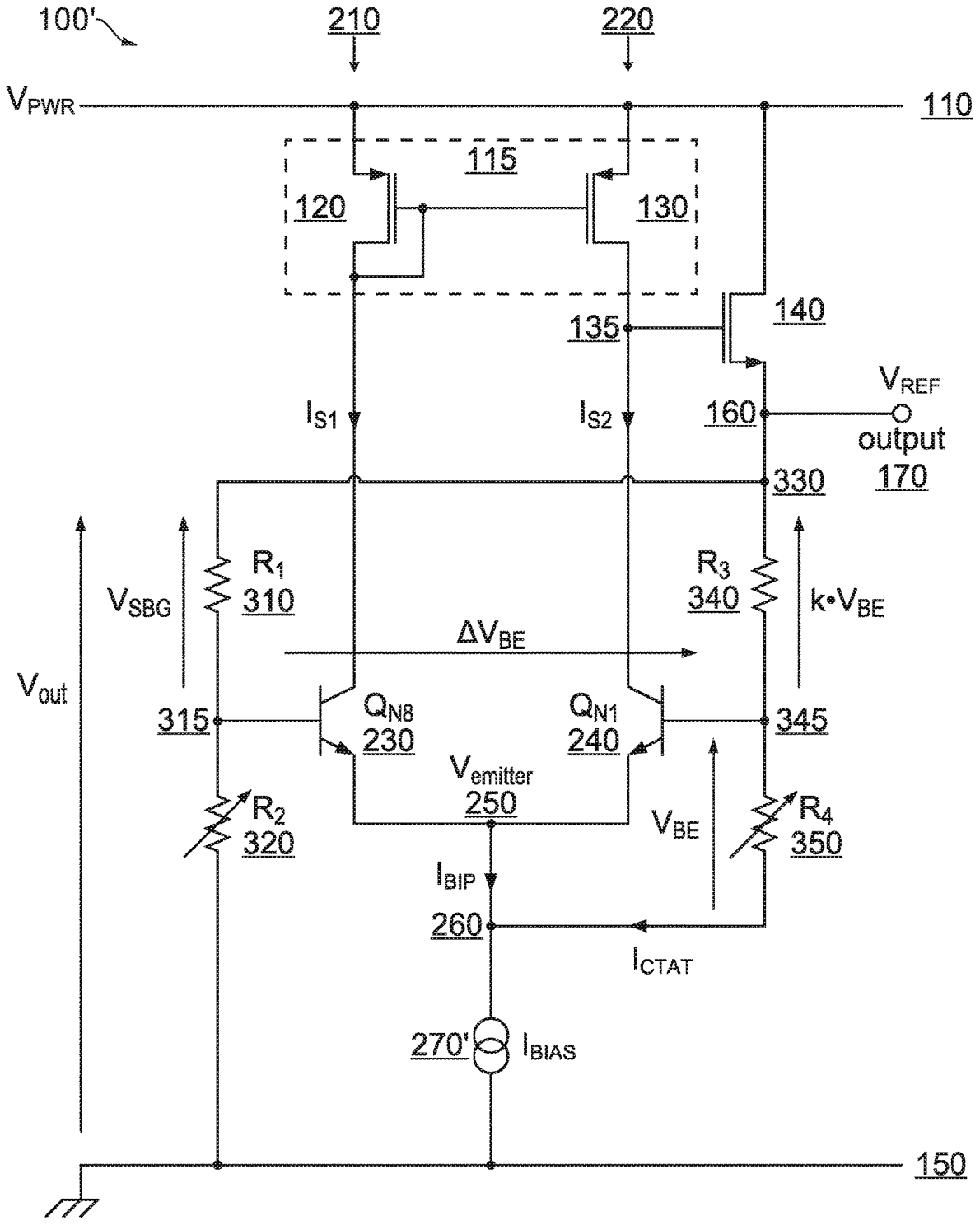
FIG. 5 schematically illustrates a circuit diagram of a bandgap reference circuit with current source according to another example of the present invention.

To determine appropriate temperature coefficients $tc_1$ and $tc_2$, the above discussed bandgap reference circuit 100 is modified by replacing the bias resistor $R_5$ 270 with a current supply (or sink) 270' having optimized properties. FIG. 5 illustrates a modified bandgap reference circuit 100' with current supply according to an example of the present application. The remaining components correspond to those in the bandgap reference circuit 100 described above with reference to FIGS. 1 to 4.

The current supply 270' supplying a nominal current of 3 μA and having a temperature dependency equal to that of the above described model of the bias resistor $R_5$ 270 with temperature coefficients $tc_1$ and $tc_2$. The temperature coefficients $tc_1$ and $tc_2$ may be varied for analysis. For instance, the temperature coefficients $tc_1$ may be varied in a range between $-3\cdot10^{-3o}$ C.$^{-1}$ and $+5\cdot10^{-3o}$ C.$^{-1}$. The temperature coefficients $tc_2$ may be varied in a range between $-5\cdot10^{-6o}$ C.$^{-2}$ and $+15\cdot10^{-6o}$ C.$^{-2}$.

Figure 6A:
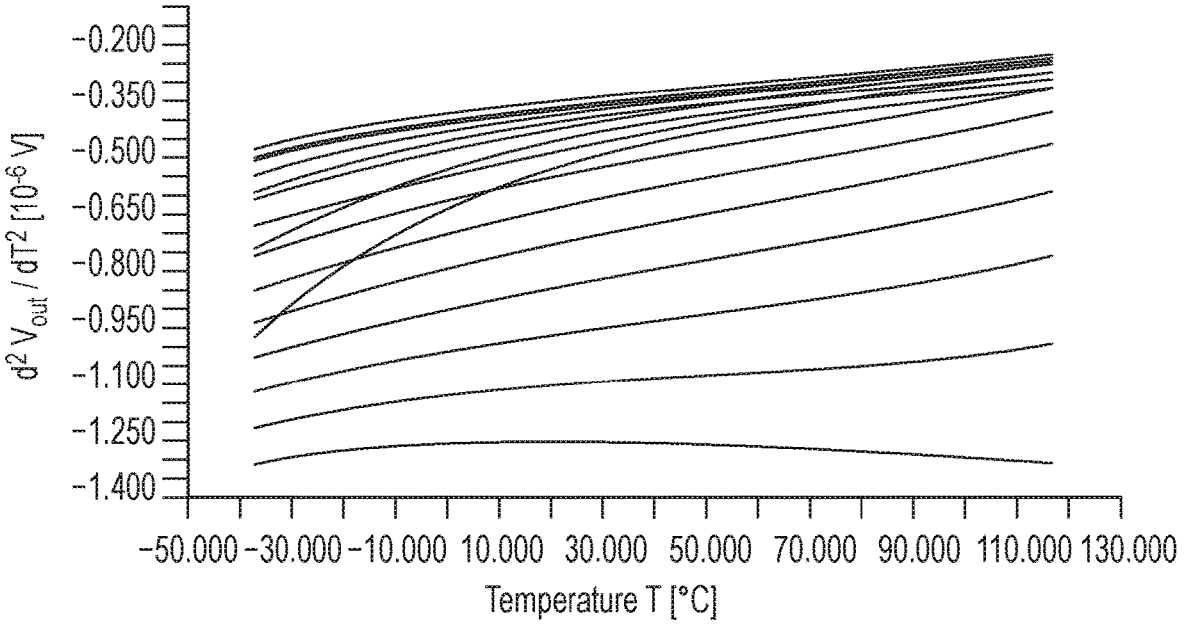
FIG. 6*a* schematically illustrates the second derivative of the output voltage $V_{REF}$ over the temperature with regard to the bandgap reference circuit of FIG. 5.
Figure 6B:
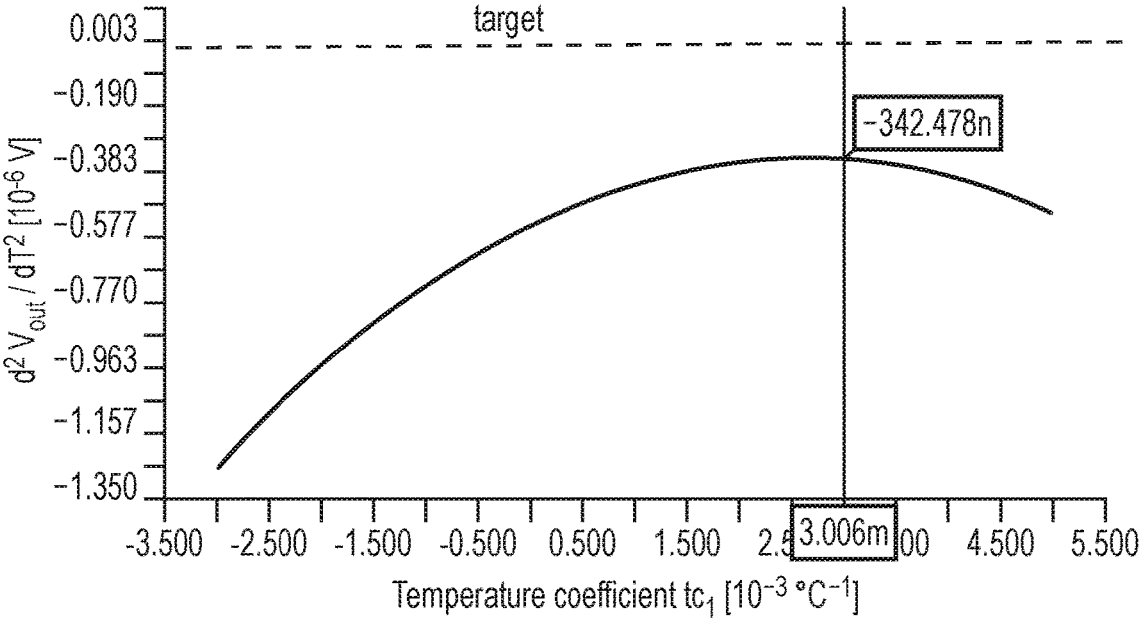
FIG. 6*b* schematically illustrates the second derivative of the output voltage $V_{REF}$ at room temperature (approx. 27° C.) over the temperature coefficient $tc_1$ with regard to the bandgap reference circuit of FIG. 5.

In a first step, the temperature coefficients $tc_2$ is set to 0° C.$^{-2}$ to study the effect of varying the temperature coefficient $tc_1$ in the range from $-3\cdot10^{-3o}$ C.$^{-1}$ to $+5\cdot10^{-3o}$ C.$^{-1}$. The current of the current supply 270' is set to 3 μA. FIG. 6*a* schematically illustrates the second derivative of the output voltage $V_{REF}$ over the temperature in the range from −40° C. to 120° C. FIG. 6*b* schematically illustrates the second derivative of the output voltage $V_{REF}$ at room temperature (approx. 27° C.) as the temperature coefficient $tc_1$ varies over the range from $-3\cdot10^{-3o}$ C.$^{-1}$ to $+5\cdot10^{-3o}$ C.$^{-1}$. The second derivative of the output voltage $V_{REF}$ has a local maximum at $tc_1=3\cdot10^{-3o}$ C.$^{-1}$ within the range of variation.

Figure 7A:
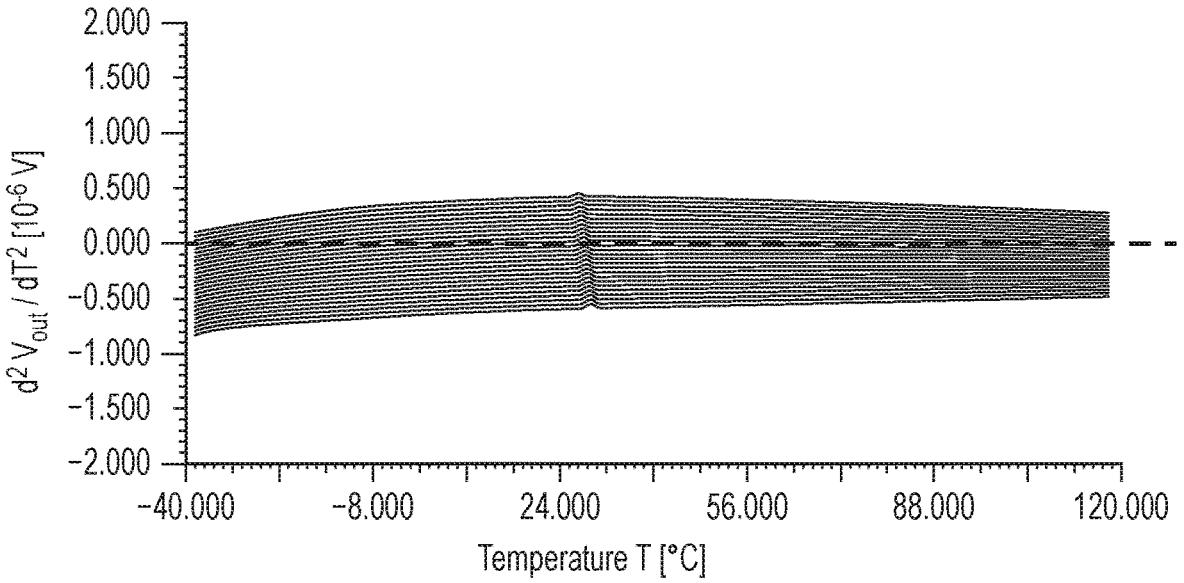
FIG. 7*a* schematically illustrates the second derivative of the output voltage $V_{REF}$ over temperature with regard to bandgap reference circuit of FIG. 5.
Figure 7B:
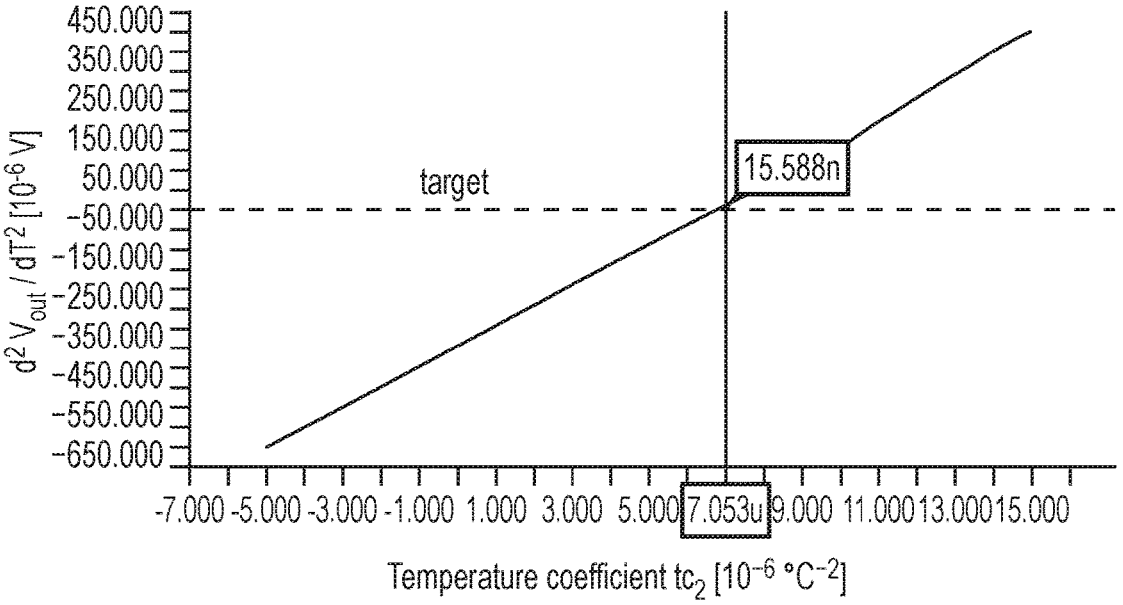
FIG. 7*b* schematically illustrates the second derivative of the output voltage $V_{REF}$ at room temperature (approx. 27° C.) over the temperature coefficient $tc_2$ with regard to bandgap reference circuit of FIG. 5.

In a next step, the temperature coefficient $tc_1$ is set to $3\cdot10^{-3o}$ C.$^{-1}$ to study the effect of varying the temperature coefficient $tc_2$ in the range from $-5\cdot10^{-6o}$ C.$^{-2}$ to $+15\cdot10^{-6o}$ C.$^{-2}$. The current of the current supply 270' is again set to 3 μA. FIG. 7*a* schematically illustrates the second derivative of the output voltage $V_{REF}$ over the temperature in the range from −40° C. to 120° C. FIG. 7*b* schematically illustrates the second derivative of the output voltage $V_{REF}$ at room temperature (approx. 27° C.) over the temperature coefficient $tc_2$ varied over the range from $-5\cdot10^{-6o}$ C.$^{-2}$ to $+15\cdot10^{-6o}$ C.$^{-2}$. The second derivative of the output voltage $V_{REF}$ changes its sign at the temperature coefficient $tc_2$ approximately $tc_2=7\cdot10^{-6o}$ C.$^{-2}$. The second derivative of the output voltage $V_{REF}$ being smaller than 0 (being negative) means that the curvature is negative whereas the second derivative of the output voltage $V_{REF}$ being greater than 0 (being positive) means that the curvature is positive.

The above determined temperature coefficients $tc_1$ and $tc_2$ may be considered as best fit temperature coefficients to optimize or minimize the curvature of the output voltage $V_{REF}$.

Figure 8:
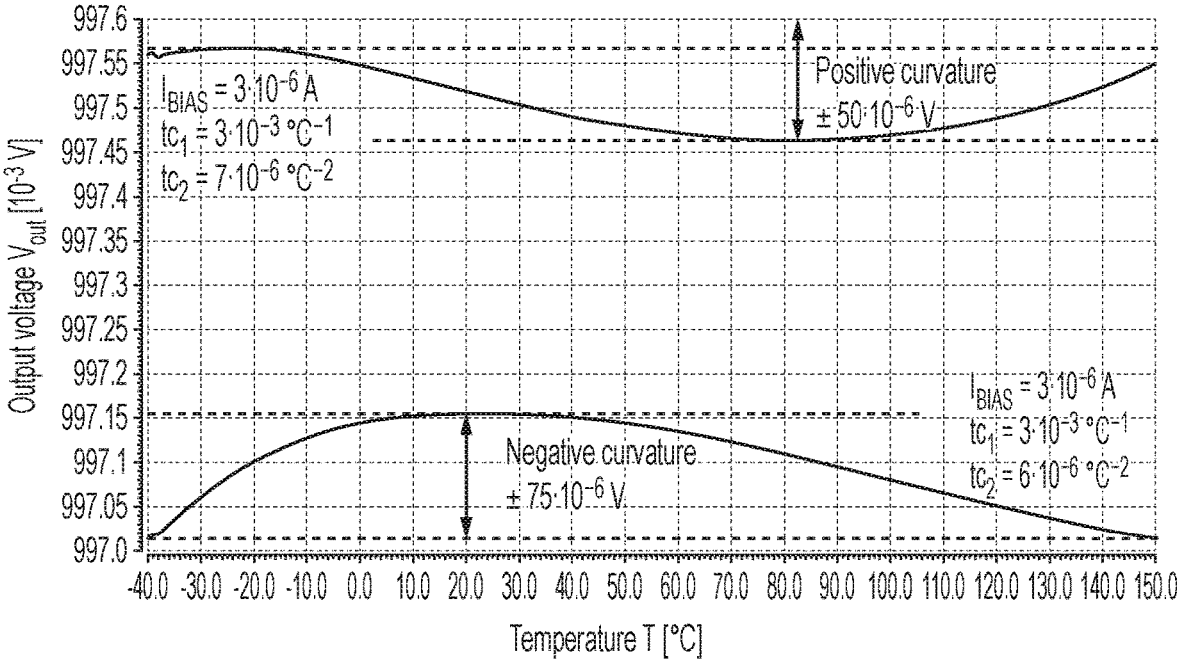
FIG. 8 schematically illustrates a diagram of the output voltage $V_{REF}$ of a modified bandgap reference circuit of FIG. 5 with two different parameter sets for the current source.

Referring to FIG. 8, a diagram of the output voltage $V_{REF}$ of the modified bandgap reference circuit 100' with two different parameter sets for the current supply 270' over the temperature range from −40° C. to 150° C. is schematically illustrated.

In general, the current supply 270' provides a temperature dependent current, which is modeled as following:

$$I_{BIAS}(T)=I_0[1+(T-T_0)\cdot tc_1+(T-T_0)^2\cdot tc_2],$$

wherein I is the output bias current $I_{BIAS}$ and $I_0$ is the output bias current at an initial temperature e.g. at room temperature $T_r$=27° C. The temperature coefficients $tc_1$ and $tc_2$ define the temperature dependency of the bias current $I_{BIAS}$.

The upper profile of the output voltage $V_{REF}$ is determined based on $I_0$=3 μA, $tc_1=3\cdot10^{-3o}$ C.$^{-1}$ and $tc_2=7\cdot10^{-6o}$ C.$^{-2}$. The lower profile of the output voltage $V_{REF}$ is determined based on $I_0$=3 μA, $tc_1=3\cdot10^{-3o}$ C.$^{-1}$ and $tc_2=6.10^{-6o}$ C.$^{-2}$. The obtained curvatures are significantly lower, which is immediately understood when comprising the profiles shown in FIGS. 8 and 2.

The above discussion of the modified bandgap reference circuit 100' enables those skilled in the art to implement a bias resistor $R_5$ 270 with an appropriate temperature dependency in order to improve the curvature of the output voltage $V_{REF}$ of the bandgap reference circuit 100. The technology, which is used to implement the bandgap reference circuit 100 may limit the choice of implementation possibilities of the bias resistor $R_5$ 270. An approach to minimize the curvature of the output voltage $V_{REF}$ of the bandgap reference circuit 100 will be described with reference to FIG. 9.

A feasible approach to minimize the curvature of the output voltage $V_{REF}$ of the bandgap reference circuit 100 is to select a bias resistor $R_5$ 270 with a temperature coefficient tc2, which is the quadratic temperature coefficient $tc_2$, as close as possible to the above discussed best fit temperature coefficient $tc_2\approx7\cdot10^{-6o}$ C.$^{-2}$. For instance, the bias resistor $R_5$ 270 may be implemented as polysilicon resistor with a quadratic temperature coefficient $tc_2\approx10\cdot10^{-6o}$ C.$^{-2}$, thereby accepting a negative linear temperature coefficient $tc_1$, which causes an increase of the bias current $I_{BIAS}$ through the bias resistor $R_5$ 270.

Figure 9:
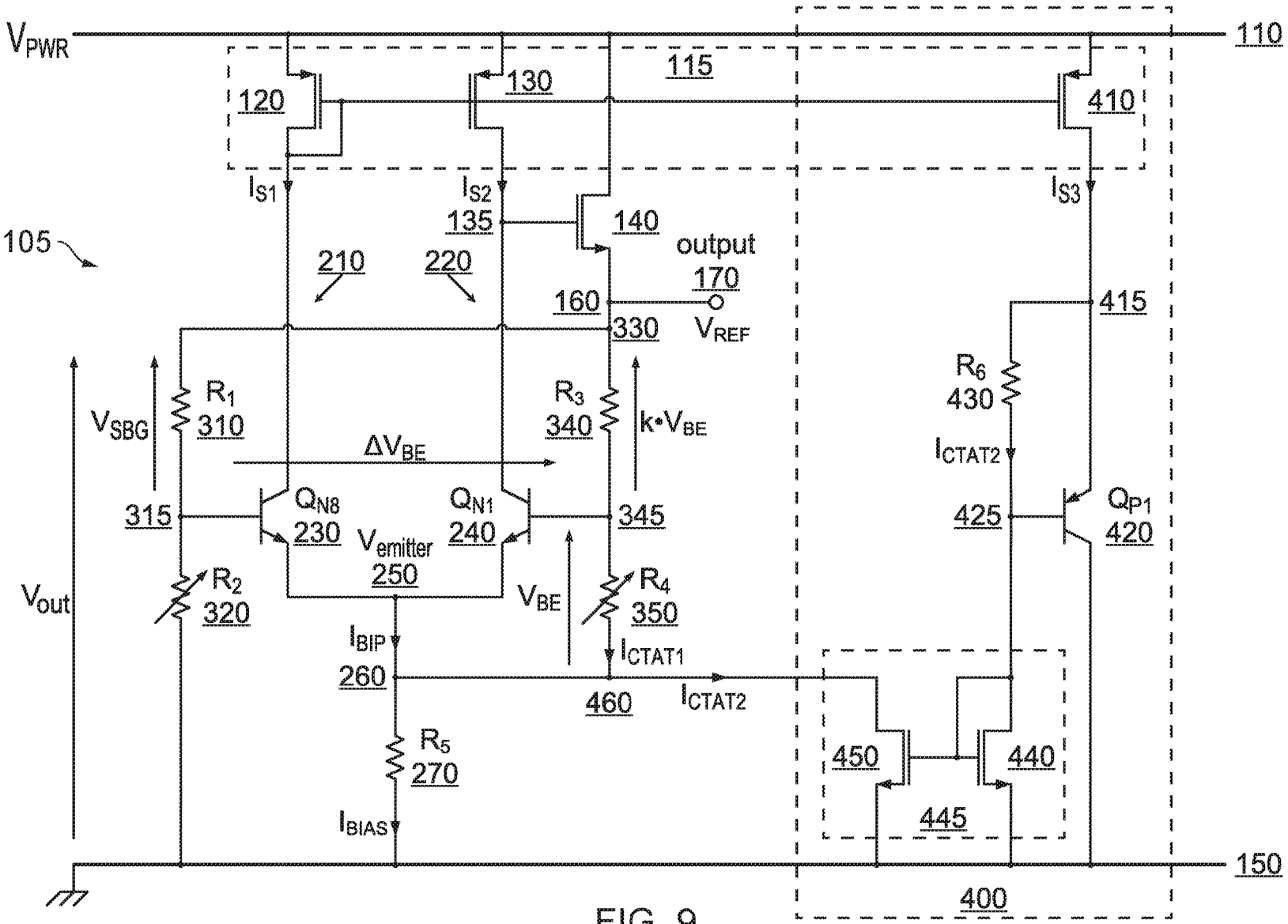
FIG. 9 schematically illustrates a circuit diagram of a bandgap reference circuit with curvature compensation according to yet another embodiment of the present application.

Referring now to FIG. 9, a schematic circuit diagram of a bandgap reference circuit 105 according to another embodiment of the present application is shown, which comprises a curvature compensation stage 400, which consumes a current from the bipolar current IBIP thereby reducing the bias current $I_{BIAS}$ through the bias resistor $R_5$ 270. Those skilled in the art will immediately understand that the bandgap reference circuit 105 described in the following corresponds to the bandgap reference circuit 100 described above but is supplemented with the curvature compensation stage 400. Hence, the above description with reference to the bandgap reference circuit 100 applies likewise to the bandgap reference circuit 105 described herein. The following description should be read in the context with the above description. It should be noted that the above introduced base-emitter current $I_{CTAT}$ will be referred to a first base-emitter current $I_{CTAT1}$ in the following.

The curvature compensation stage 400 is also supplied by the current supply. In particular, the current mirror circuitry 115 provides a current $I_{S3}$ a respective output. The current mirror circuitry 115 supplies the same current $I_S$ at the outputs, e.g. $I_S=I_{S1}=I_{S2}=I_{S3}$. In an example, the current mirror circuitry 115 further comprises a transistor 410 providing the source current signals $I_{S3}$ at one of its current terminals, whereas the other one of its current terminals is coupled to the supply voltage rail 110. In particular, the control terminal of the transistor 410 is connected to the current terminal of the transistor 120 providing the source current signal $I_{S1}$ and further to the control terminals of the transistors 120 and 130.

In an example, the transistor 410 is a MOSFET (metal-oxide-semiconductor field-effect transistor). In particular, the transistor 410 is p-channel MOSFET. The source terminal of the transistor 410 is connected to the supply voltage rail 110. The drain terminal of the transistor 410 supplies the source current signal 183. The gate terminal of the transistor 410 is connected to the drain terminal of the transistor 120 and to the gate terminals of the transistors 120 and 130.

The current supply supplies the source current signal $I_{S3}$ to a further branch comprising a bipolar junction transistor (BJT) 420. In particular, the BJT 420 is a pnp-type bipolar transistor. A first current terminal of the BJT 420 is connected to the respective output of the current mirror circuitry 115. In an example, the emitter terminal of the BJT 420 is connected to the current supply and the collector terminal of the BJT 420 is connected to ground, e.g. the ground rail 150.

A resistor $R_6$ 430 is connected between to the first current terminal of the BJT 420 the control terminal of the BJT 420. In particular, the resistor $R_6$ 430 is connected between the emitter terminal and the base terminal of the BJT 420. Hence, a base-emitter voltage $V_{BE}$ of the BJT 420 occurs across the resistor $R_6$ 430, which causes a compensation current $I_{CTAT2}$ to flow through the resistor $R_6$ 430.

A further current mirror circuitry 445 is connected between the control terminal of the BJT 420 and ground. The current mirror circuitry 445 accepts the compensation current $I_{CTAT2}$ flowing through the resistor $R_6$ 430 and consumes an equivalent compensation current $I_{CTAT2}$ from the base-emitter current $I_{CTAT1}$. For instance, the current mirror circuitry 445 has a first input to accept the compensation current $I_{CTAT2}$ and a second input to consume the equivalent compensation current $I_{CTAT2}$ from the base-emitter current $I_{CTAT1}$. The first input is connected to a node 425 between control terminal of the BJT 420 and the resistor $R_6$ 430 and the second input is connected to a node 460 between the resistor $R_4$ 350 and the bias resistor $R_5$ 270.

Hence, the bias current $I_{BIAS}$ is reduced by the equivalent compensation current $I_{CTAT2}$:

$$I_{CTAT1} = \frac{V_{BE}(Q_{N1})}{R_4};$$

-continued $$I_{CTAT2} = \frac{V_{BE}(Q_{P1})}{R_6}$$

$$I_{BIAS} = I_{BIP} + I_{CTAT1} - I_{CTAT2} = I_{BIAS} + \frac{V_{BE}(Q_{N1})}{R_4} - \frac{V_{BE}(Q_{P1})}{R_6}.$$

The current mirror circuitry 445 comprises in particular transistors 440 and 450. More particularly, the control terminal of the transistor 450 is connected to the current terminal of the transistor 440 accepting the compensation current $I_{CTAT2}$ and is further connected to the control terminal of the transistor 440.

In an example, the transistors 440 and 450 are MOSFETs (metal-oxide-semiconductor field-effect transistor). In particular, the transistors 440 and 450 are n-channel MOSFETs. The source terminals of the transistors 440 and 450 are connected to ground, e.g. the ground rail 150. The drain terminal of the transistor 440 is connected to the node 425, which is connected in series between the resistor $R_6$ 430 and the base terminal of the BJT 420 and accepts the compensation current $I_{CTAT2}$ flowing through the resistor $R_6$ 430. The gate terminal of the transistor 450 is connected to the drain terminal and to the gate terminal of the transistor 440.

Figure 10:
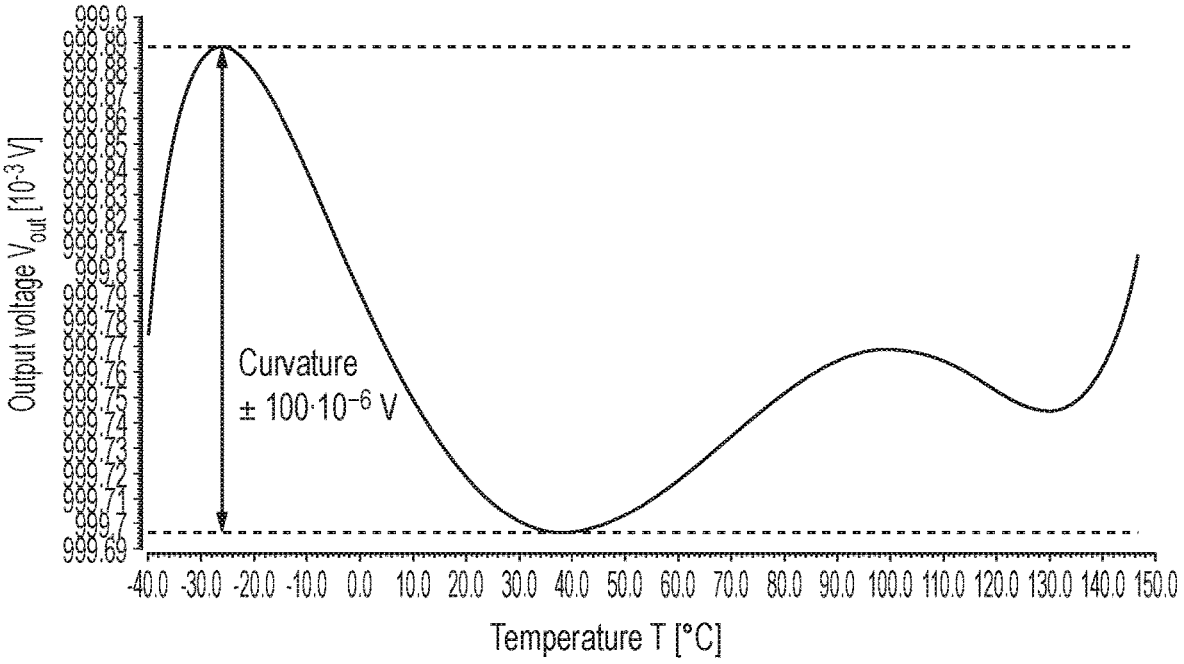
FIG. 10 schematically illustrates a diagram of the output voltage $V_{REF}$ of the bandgap reference circuit of FIG. 10.

Referring now to FIG. 10, a diagram of the output voltage $V_{REF}$ of the above described bandgap reference circuit 105 with curvature compensation over the temperature range from −40° C. to 150° C. is schematically illustrated. The above described curvature compensation enables the curvature to be limited to approximately ±100 μV.

In an example, a base current compensation for the base currents of the BJTs 230 and 240 may be further implemented in the above described bandgap reference circuits 100 and 105, respectively. To compensate the base currents of the BJTs 230 and 240, a first compensation resistor having a resistance substantially equal to the resistance of the resistor $R_3$ 340 may be connected in series with the base terminal of the BJT 230 and a second compensation resistor having a resistance substantially equal to the resistance of the resistor $R_1$ 310 may be connected in series with the base terminal of the BJT 240. In particular, the first compensation resistor may be connected in series between the base terminal of the BJT 230 and the node 315 and the second compensation resistor may be connected in series between the base terminal of the BJT 240 and the node 345. The current gain values B of the BJTs 230 and 240 differ due to their differing emitter current densities. The differing gain values B of the BJTs 230 and 240 may be compensated by tuning the first compensation resistor arranged at the base terminal of the BJT 230.

Figure 11:
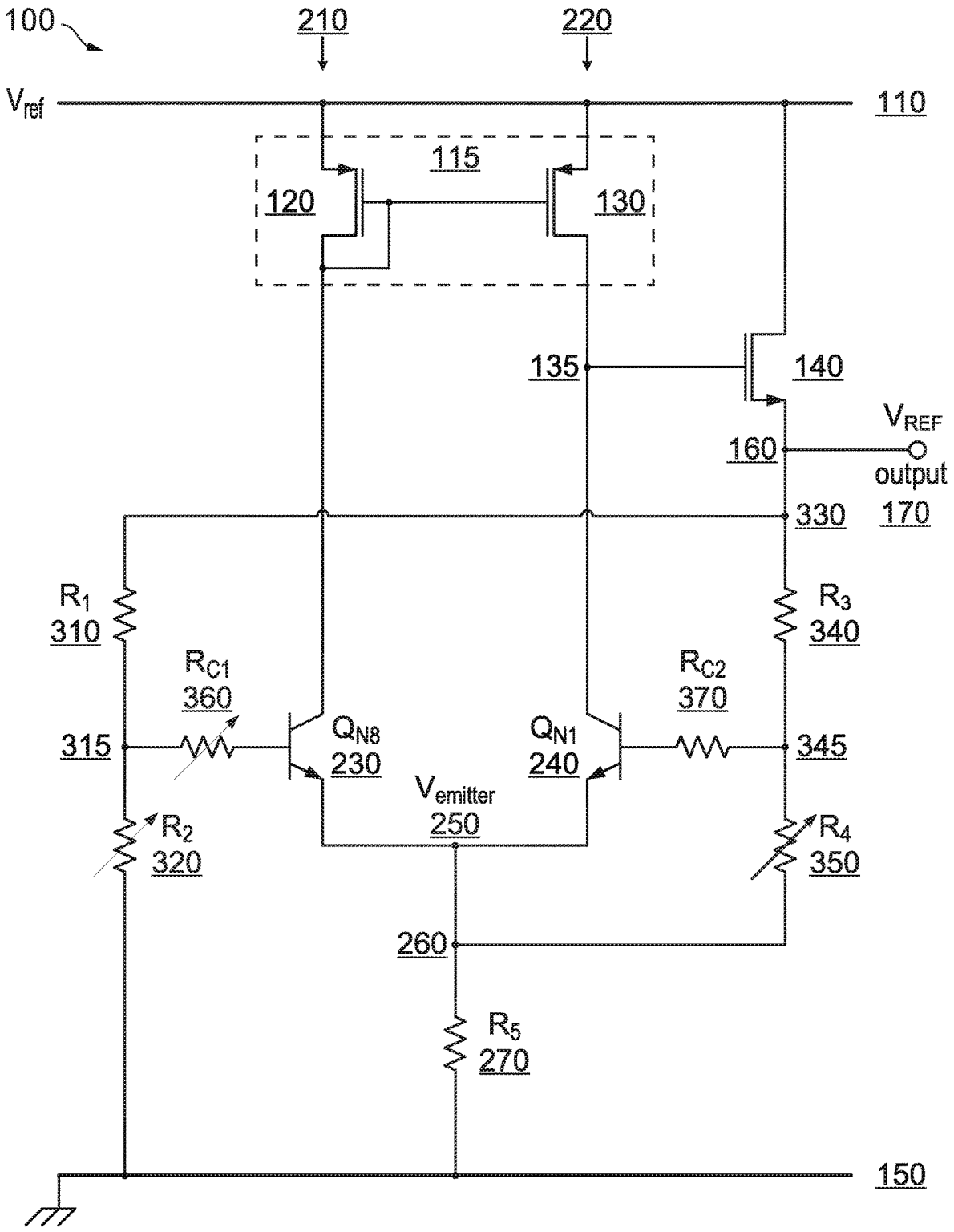
FIG. 11 schematically illustrates a circuit diagram of a bandgap reference circuit with base current compensation according to yet another embodiment of the present application.

The base current compensation is exemplarily illustrated in FIG. 11 in connection with the above exemplified bandgap reference circuit 100 of FIG. 1. The base current compensation comprises the first compensation resistor $R_{C1}$ 360 and the second compensation resistor $R_{C2}$ 370 each connected to a respective one of the base terminals of the BJTs 230 and 240. The base current compensation further minimizes the curvature of the output voltage $V_{REF}$. The base current compensation is likewise applicable with the above exemplified bandgap reference circuit 105 of FIG. 9.

According to an example of the present application, a sub-bandgap reference source circuit is provided. The circuit comprises a current mirror source arranged to supply a same current to a first branch comprising a first bipolar junction transistor, BJT, and a second branch comprising a second bipolar junction transistor, BJT. The first BJT has an emitter current density, which is lower than the emitter current density of the second BJT. The first branch and the second branch are connected at a first node, which is coupled to ground. The circuit further comprises a first voltage divider comprising a first resistance and a second resistance coupled in series. The first resistance is coupled between a base terminal of the first BJT and a second node. The second resistor is coupled to ground. The circuit further comprises a second voltage divider comprising a third resistance and a fourth resistance coupled in series. The third resistance is coupled between the second node and a base terminal of the second BJT. The fourth resistance is coupled to the first node. The circuit further comprises an output terminal coupled to the second node.

According to an example, the first and second BJTs are npn-type bipolar transistors.

According to an example, the circuit further comprises a supply voltage rail coupled to the current mirror source.

According to an example, the circuit further comprises a transistor having a first current terminal coupled to the supply voltage rail, a second current terminal coupled to the second node and a control terminal coupled to the second branch.

According to an example, the first current terminal is a drain terminal and the second current terminal is a source terminal.

According to an example, the circuit further comprises a bias resistance coupled between the first node and ground.

According to an example, the first resistance and/or the second resistance of the first voltage divider is a trimmable resistance.

According to an example, the first resistance and/or the second resistance of the second voltage divider is a trimmable resistance.

According to an example, the emitter density of the first BJT is of a factor higher than the emitter density of the second BJT. The factor is higher than 1. In an example, the factor is in the range of 8 to 15, in particular the factor is substantially 8.

According to an example, the current mirror source comprises two transistors. The gate terminals of the two transistors are connected to each other and to a drain terminal of one of the two transistors.

According to an example, the first BJT has a collector terminal coupled to the current mirror source and an emitter terminal coupled to the first node. The second BJT has a collector terminal coupled to the current mirror source and an emitter terminal coupled to the first node.

According to an example, the circuit further comprises a third branch supplied by the current mirror source with a second current. The third branch includes a third bipolar junction transistor, BJT, and a resistance coupled between the current mirror source and a base terminal of the third BJT. The circuit further comprises a current mirror coupled between the base terminal of the third BJT and ground. The current mirror is further coupled between the first node and ground.

According to an example, the same current and the second current has a predetermined fixed ratio. In an example, the second current and the second current have the same value.

According to an example, the third BJT is a pnp-type bipolar transistor.

According to an example, the current mirror comprises two transistors. Gate terminals of the two transistors are connected to each other and to a drain terminal of one of the two transistors, which is coupled to the base terminal of the third BJT.

Those of skill in the art would understand that information and signals may be represented using any of a variety of different technologies and techniques. Those of skill would further appreciate that the various illustrative logical blocks, modules, circuits, and algorithm steps described in connection with the disclosure herein may be implemented as electronic hardware, computer software, or combinations of both. To illustrate clearly this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

The invention claimed is:

1. A sub-bandgap reference source circuit, comprising:

a current mirror source arranged to supply a same current to a first branch comprising a first bipolar junction transistor, BJT, and a second branch comprising a second bipolar junction transistor, BJT, wherein the first BJT has an emitter current density, which is lower than the emitter current density of the second BJT, wherein the first branch and the second branch are connected at a first node, which is coupled to ground, a first voltage divider comprising a first resistance and a second resistance coupled in series, wherein the first resistance is coupled between a base terminal of the first BJT and a second node, wherein the second resistor is coupled to ground;

a second voltage divider comprising a third resistance and a fourth resistance coupled in series, wherein the third resistance is coupled between the second node and a base terminal of the second BJT, wherein the fourth resistance, is coupled to the first node; and an output terminal coupled to the second node.

2. The sub-bandgap reference source circuit according to claim 1, wherein the first and second BJTs are npn-type bipolar transistors.

3. The sub-bandgap reference source circuit according to claim 1, further comprising:

a supply voltage rail coupled to the current mirror source.

4. The sub-bandgap reference source circuit according to claim 3, further comprising:

a transistor having a first current terminal coupled to the supply voltage rail, a second current terminal coupled to the second node and a control terminal coupled to the second branch.

5. The sub-bandgap reference source circuit according to claim 4, wherein the first current terminal is a drain terminal and the second current terminal is a source terminal.

6. The sub-bandgap reference source circuit according to claim 1, further comprising:

a bias resistance coupled between the first node and ground.

7. The sub-bandgap reference source circuit according to claim 1, wherein at least one of the first resistance and the second resistance of the first voltage divider is a trimmable resistance.

8. The sub-bandgap reference source circuit according to claim 1, wherein at least one of the first resistance and the second resistance of the second voltage divider is a trimmable resistance.

9. The sub-bandgap reference source circuit according to claim 1, wherein the emitter density of the first BJT is higher than the emitter density of the second BJT by a factor higher than 1.

10. The sub-bandgap reference source circuit according to claim 1, wherein the current mirror source comprises two transistors, wherein gate terminals of the two transistors are connected to each other and to a drain terminal of one of the two transistors.

11. The sub-bandgap reference source circuit according to claim 1, wherein the first BJT has a collector terminal coupled to the current mirror source and an emitter terminal coupled to the first node, wherein the second BJT has a collector terminal coupled to the current mirror source and an emitter terminal coupled to the first node.

12. The sub-bandgap reference source circuit according to claim 1, further comprising a third branch supplied by the current mirror source with the a second current, wherein the third branch includes:

a third bipolar junction transistor, BJT, and a resistance coupled between the current mirror source and a base terminal; and a current mirror coupled between the base terminal of the third BJT and ground, wherein the current mirror is further coupled between the first node and ground.

13. The sub-bandgap reference source circuit according to claim 12, wherein the same current and the second current have a predetermined fixed ratio.

14. The sub-bandgap reference source circuit according to claim 11, wherein the third BJT is a pnp-type bipolar transistor.

15. The sub-bandgap reference source circuit according to claim 11, wherein the current mirror comprises two transistors, wherein gate terminals of the two transistors are connected to each other and to a drain terminal of one of the two transistors, which is coupled to the base terminal of the third BJT.

* * * * *